United States Patent [19]

Gogniat

[11] Patent Number: 4,681,461

[45] Date of Patent: Jul. 21, 1987

[54] ELECTRONIC WATCH WITH OPERATING CONTROLS IN THE BACK COVER OF THE CASE

[75] Inventor: Paul Gogniat, Bienne, Switzerland

[73] Assignee: Montres Rado S.A., Switzerland

[21] Appl. No.: 919,394

[22] Filed: Oct. 16, 1986

[30] Foreign Application Priority Data

Oct. 31, 1985 [CH] Switzerland ..... 04692/85

[51] Int. Cl.[4] ..... G04C 17/00; G04C 9/00

[52] U.S. Cl. ..... 368/69; 368/187; 368/282; 368/309

[58] Field of Search ..... 368/69–70, 368/88, 185–187, 276, 266–282, 308–309, 319–321

[56] References Cited

U.S. PATENT DOCUMENTS

| | | | |
|---|---|---|---|
| 3,884,033 | 5/1975 | Wood | 368/187 |
| 3,983,690 | 5/1976 | McClintock | 58/50 R |
| 4,103,483 | 1/1978 | Riley | 58/90 R |
| 4,323,996 | 6/1982 | Ganter | 368/80 |
| 4,511,260 | 4/1985 | Pasquier | 368/309 |

FOREIGN PATENT DOCUMENTS

| | | |
|---|---|---|
| 2940246 | 4/1981 | Fed. Rep. of Germany . |
| 2212574 | 7/1974 | France . |
| 2312058 | 12/1976 | France . |

*Primary Examiner*—Vit W. Miska

*Attorney, Agent, or Firm*—Griffin, Branigan & Butler

[57] ABSTRACT

The back cover of the case is provided with positioning means which determine more or less precisely the location where means external to the case must be placed in order to actuate each control mechanism.

Such positioning means may for example take the form of grooves at the bottom of each of which is located a control mechanism and into which may be introduced a portion of the securing element of the bracelet.

It might likewise comprise protuberances or portions in relief or cavities of more complex form, the remaining parts forming guide means for guiding the external actuating means toward such positioning means.

This invention concerns electronic watches having a system of operating controls located in the back cover of their cases.

The term "system of operating controls" here designates all or part of the mechanisms or components which are available to the user in order to permit him to accomplish time setting of the watch and eventually to exercise control over supplementary functions which such watch may be capable of accomplishing, as for instance that of a calendar or alarm. Naturally this definition does not exclude cases where the system is limited to a single mechanism. This may happen when the watch is of a simple nature and intended to indicate only hours and minutes, or because it is capable of responding differently according to whether one actuates the mechanism during a very short interval or relatively long interval, or more or less frequently during a predetermined time interval.

17 Claims, 7 Drawing Figures

ELECTRONIC WATCH WITH OPERATING CONTROLS IN THE BACK COVER OF THE CASE

BACKGROUND OF THE INVENTION

The control systems known at present and which may be placed in the back cover of a case are numerous. They may, for instance, comprise movable or stationary components which react to pressure (push-buttons, membranes associated with an internal electrical contact, piezo-electric keys). Arrangements may also be provided which operate according to a purely electrical principle (capacitive keys, simple insulated contacts which are grounded by touching with the finger or by connecting them to the watch case by means of a metallic object, contact pairs which may be coupled between themselves). Finally, there may also be cited electromagnetic arrangements which comprise a relay housed entirely within the watch which may be actuated from the exterior by employing a small magnet.

Actually, this possibility of placing the control system of a watch behind the latter has up to the present been only rarely employed. However, it would quite often enable simplification of the fabrication of the movement, of the case or of the control mechanisms themselves, to facilitate their assembly or simply to resolve the problems associated with water tightness. For instance, in very thin watches, i.e. 3 mm or less, it is very difficult to make one or several holes in the caseband to accommodate a time setting stem or to house push-buttons while providing the necessary sealing means without risk of rendering such watches very fragile. Since moreover for the most part top quality watches are concerned, it is out of the question to locate such visible mechanisms as push-buttons or fixed electrical contacts in front of the watch and even arrangements still little employed such as photo diodes or capacitive keys on the crystal, which incidentally are difficult to adjust and necessitate complex electronic circuits, are only rarely suitable. The solution obtained by placing these control arrangements on the back-cover of the watch would thus in such cases be very advantageous. However, resort is made thereto only when truly obliged to do so and this for the same reasons that utilization for certain styles of watches is avoided where even the presence of a stem becomes unattractive and where, consequently, it would be likewise interesting.

One of the reasons for avoiding this solution is that with certain exceptions, as with pendant watches, it obliges the watch wearer to put it down when he wishes to undertake an adjustment or otherwise to control it. In reality, this does not represent a serious difficulty since it is not infrequent that one also does the same thing with a watch provided with a classical system of correction on finding that manipulations are easier thereby.

The other reason is that generally, the wearer experiences far more difficulties in setting the time and in some cases controlling other functions than if the control mechanism or mechanisms were placed in front of the watch or on the side. Effectively, in this case he must begin by looking at the back of the watch to see where is to be found the mechanism which must be actuated and according thereto, place the end of the finger or a suitable object on or close to the latter. Without so doing, he would risk groping for considerable time and, if there are several mechanisms, to be mistaken. Next he must turn over the watch to observe the modifications of the display while he acts on the mechanism and it is entirely possible that at a given moment including when he turns the watch over, his finger or the object in question slides on the back cover or is removed therefrom. It remains then to recommence the same manoeuvre.

This difficulty is much more bothersome than the preceding one and what the invention has as purpose is not to suppress it for this is almost impossible, but to minimize it.

In other words, the purpose of the invention is to seek to render a control system situated on the back cover of a watch case as practical to employ as those which are found on the side or in front, the latter being likewise, from this viewpoint, not always perfect.

This purpose is attained owing to the fact that when a control system is fixed to the back cover of a watch in conformity with the invention, this back cover is provided with positioning means which determine approximately at least the place where the means external to the case must be placed in order to be able to actuate the mechanism in question.

Furthermore, in the preferred method of carrying out the invention, the back cover of the case is likewise provided with means for guiding these external actuating means towards the positioning means.

When the watch likewise comprises a bracelet with a closing element, it is advantageous to be able to employ a portion of this element as means for actuating the control system since one has such element permanently and immediately at hand. Consequently, in this case, the positioning means and eventually guide means are preferably adapted to the form and to the dimensions of this portion of the closing element and the control mechanism is chosen in a manner to be capable of actuation thereby.

SUMMARY OF THE INVENTION

The invention accordingly comprises a case having a back cover and at least one control mechanism fixed to said back cover, said back cover having positioning means which determine at least approximately the location at which means external to the case must be placed in order to actuate said control mechanism.

DESCRIPTION OF THE PREFERRED EMBODIMENT

Figure 1:
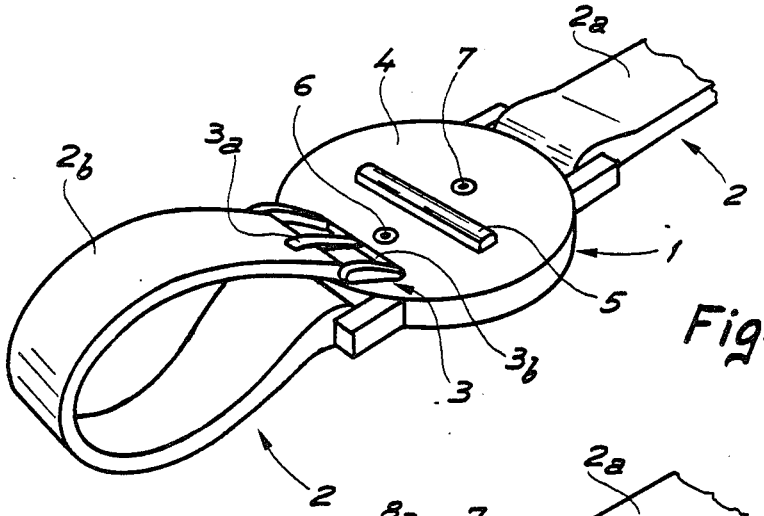
FIGS. 1 to 4, 5 and 6 show totally or partially six different wristwatches in conformity with the invention.
Figure 2:
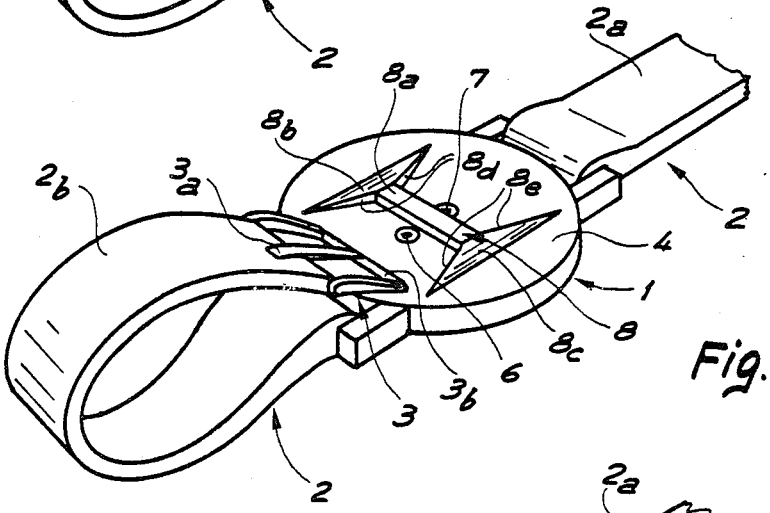
Figure 3:
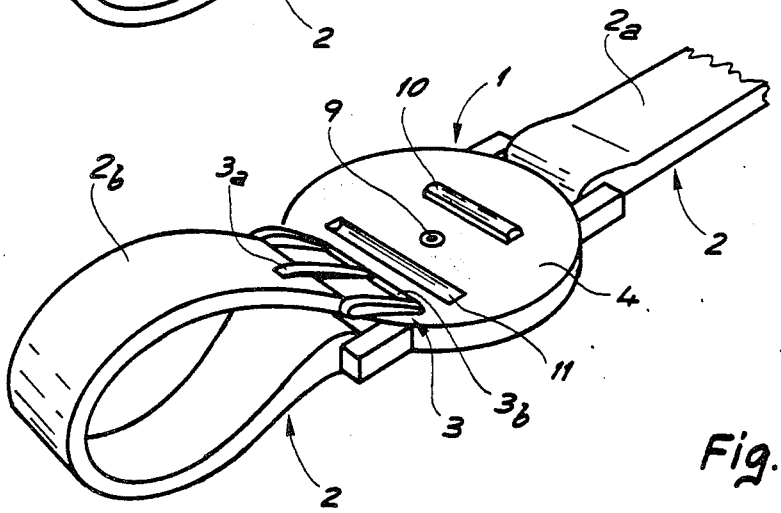

The watches of FIGS. 1 to 3 each comprise a case 1 which contains the various elements necessary to the realization of a watch which could have analog, digital or mixed display and to which is attached a flexible bracelet 2 of a classic type with a strand $2_a$ pierced with a series of holes not visible on the drawing and another strand $2_b$ at the end of which is found a metallic buckle 3 with a tongue $3_a$.

The nature of the bracket's strands and the manner in which they are fastened to the case are unimportant. On the other hand for a reason which will be readily understood hereinafter, it is desirable that the buckle 3 be rectangular, or at least that the transversal portion $3_b$ against which the free end of the tongue is normally supported, be essentially straight and extend approximately over the entire width of the bracelet.

As far as case 1 is concerned, it has been shown as being round on the three figures, but it could just as well be rectangular, oval or of another form. It may be of any structure whatsoever on condition that it be provided with a metallic back cover 4.

In the case of the watch of FIG. 1, this back cover 4 exhibits in its central portion an elongated and substantially rectilinear protuberance 5 situated substantially perpendicular to the longitudinal direction of the strands $2_a$ and $2_b$ of the bracelet. The form of this protuberance may be for instance that of a rectangular parallelepipedon, that of a prism having a trapezoidal section or that of a half-cylinder. Generally seen, this form of protuberance 5 as well as the dimensions thereof are chosen in a manner such that on the one hand it may not be in the way and will be preferably invisible when the watch is worn on the wrist, and on the other hand it will form an obstacle which may not be avoided nor easily crossed over when as will be seen further on, the transversal portion $3_b$ of the buckle is caused to slide on the back cover of the case in the direction thereof.

This watch furthermore includes two control mechanisms constituted by two fixed contacts 6 and 7 which are incorporated in the back cover, in a manner to be electrically insulated therefrom and which are placed on either side of the protuberance 5, at a certain distance therefrom and approximately along the median line of the back cover which is perpendicular thereto.

For the electronic circuit of the watch of which it evidently forms part, the two contacts 6 and 7 may not be considered as being actuated except when they are connected to the bottom 4 by a metallic object and by which they may be so connected by the transversal portion *3b* of the bracelet buckle and it is necessary at least that they be flush with the external surface of the bottom. In fact it is preferable that they project slightly without however hindering the sliding movement of the buckle along the back cover as mentioned previously. This may be achieved by giving to the projecting portion thereof the form of a spherical cap. Furthermore, they must not be very far from the protuberance 5 in order to avoid that they be involuntarily actuated in case one should place the watch on a metallic surface.

If the watch is very simple and has no other functions than that of indicating the time of day, the contacts may serve for instance respectively to advance it and to retard it, or to effect corrections of the date, i.e. change the display of one or several entire hours, and to set the time, i.e. correct the indication of minutes together or not with that of hours. If the watch is more complicated, one contact may be provided to select information (hours, minutes, week day, date, alarm hour, alarm minute, etc.) and the other to correct or adjust this.

To act on one of the contacts, one may initially apply the transversal portion $3_b$ of the buckle 3 against the back cover in the zone which is to be found between this contact and the closest strand of the bracelet as shown on the figure, then to displace it in the direction towards the protuberance 5. The contact is actuated at the moment when the buckle passes over it. In order that it be actuated a second time, it suffices to bring back the buckle and if this is not sufficient, one may then effect a back and forth movement along the back cover until the contact has been actuated the number of times desired.

When the operation is terminated, at least temporarily with this contact, one may, if necessary, act thereafter in the same manner on the other after having brought the portion $3_b$ into contact with the back cover close to the place where such is attached to the other strand of the bracelet or even, simply, after having passed the buckle above the protuberance.

As may be imagined, this may be effected very easily without the necessity of looking at the back of the watch, even when beginning, and without losing sight of the display. Furthermore, in view of the presence of the protuberance, there is no risk when one acts on one of the contacts, of acting involuntarily on the other, even when the buckle is subjected to a rapid back and forth movement. Consequently, there are no greater difficulties in controlling the watch and there are no greater chances of being mistaken in so doing than if one were provided with control mechanisms placed on the side of the watch or in front thereof.

Naturally, this is in a large measure due to the fact that the portion $3_b$ of the buckle is straight and sufficiently long. It would not be the same if it were for instance very much rounded off.

On the other hand, it is clear that for most cases these advantages which the watch of FIG. 1 provides remain, as in all watches conforming to the invention relative to known watches provided with control systems at the back, even if one does not proceed in the manner indicated to actuate the contacts. This manner of operation has been chosen as an example since it is very easy, but there exists others. Effectively, there is no obligation to begin by placing the transversal portion of the buckle between the contact which one wishes to actuate and the strand of the bracelet which is closest. One may bring it into contact with the back cover in observing only that one is at the correct side of the protuberance and if one does not hit the contact immediately, one may find it very rapidly by displacing the buckle. In the same manner, one is not obliged to subject the buckle to a back and forth movement on the back cover in order to act several times on the same contact. When it has been actuated a first time, the transversal portion of the buckle may be separated therefrom while maintaining or not one of the extremities thereof supported against the back cover, bringing it back over the contact and continuing thusly, but the manipulation is then less easy and less rapid. On the other hand, there is nothing to prevent employing other articles than the buckle in order to actuate the contacts. One may for instance employ a coin, a key, a ballpoint pen if it is metallic or an element which serves to hook the watch into a pocket.

In the case of the watch of FIG. 1, the protuberance 5 constitutes the positioning means, particularly for the portion $3_b$ of the buckle and in this sense it limits the displacements of the latter on the back cover to zones in which are to be found the contacts and may help to keep such portion parallel thereto, thus to diminish the probability nevertheless very small, that it misses the contacts when it is subject to the back and forth movement previously mentioned.

Such protuberance would play the same role or approximately so if it were not perpendicular, but parallel to the direction of the bracket strands, the contacts continuing as may be well understood to be placed on each side thereof. On the other hand, it would form positioning means clearly more precise if it were to remain perpendicular to the direction of the bracelet strands and if the contacts were placed not at a certain distance, but just beside it. These two variants of the watch of FIG. 1 are clearly envisaged. The second would permit to limit even further the risks of involuntary actuation of the contact, but always compared with the most simple method of back and forth motion of the buckle on the back cover, it would require more time for the same number of actuations.

Figure 4:
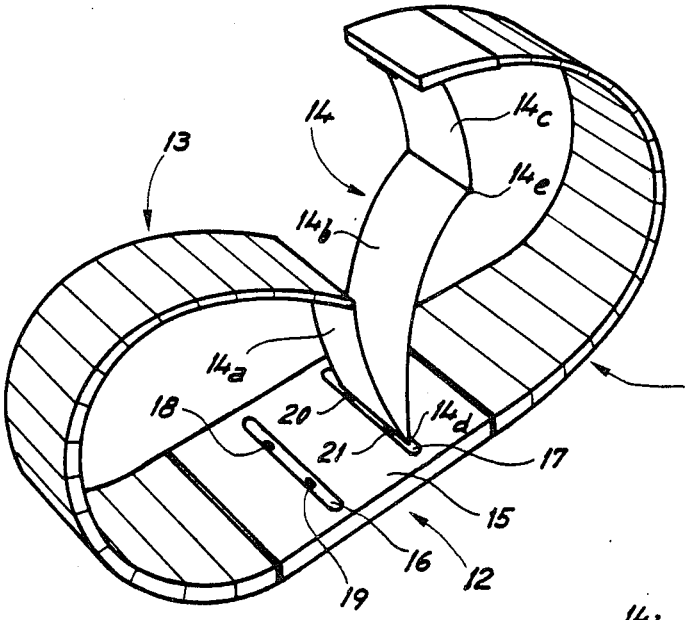
Figure 5:
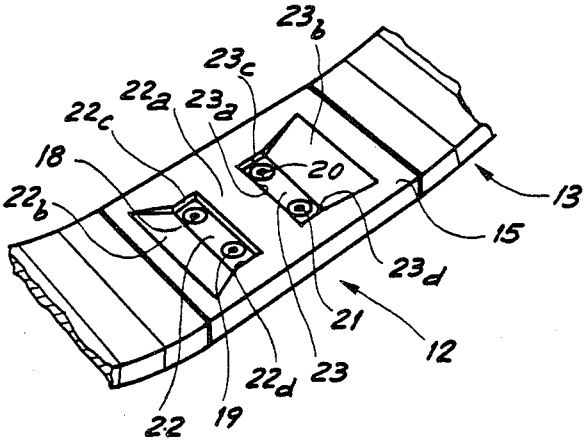

It is likewise entirely possible to replace the bracelet with buckle 2 by another for which the protuberance 5 and the contacts 6 and 7 would be likewise equally adapted and, in particular, by that with which the watches of FIGS. 4 and 5 are equipped. To avoid having to return to this subject, it may be immediately stated that this is applicable likewise to the method of execution of FIGS. 2 and 3 and that, on the other hand, the bracelet on FIGS. 4 and 5 could very well be associated with the cases of FIGS. 1 to 3. In so stating, no account is taken of the manner in which the bracelets may be fixed to the cases.

The metallic back cover 4 of the watch of FIG. 2 presents likewise a protuberance 8 but the latter has essentially the form of an H. The transversal bar $8_a$ of the H is arranged in the same manner as the protuberance 5 of the watch of FIG. 1 and has a length equal to or slightly greater than that of the transversal portion $3_b$ of the buckle 3 of the bracelet. On the other hand, the two lateral bars $8_b$ and $8_c$ of the H are formed in a manner to have facing sides $8_d$ and $8_e$ almost perpendicular to the bottom 4 or at least strongly inclined relative to the latter and to diverge from one another in the direction away from the transversal bar $8_a$. Finally, the watch further includes two electrical fixed contacts which are designated by the same references 6 and 7 as those of FIG. 1 since they are identical thereto and are to be actuated in the same manner. The sole difference is that they are not distanced from the protuberance, but in immediate proximity to the transversal bar $8_a$ to the extent that in order to actuate them, the portion $3_b$ of the buckle must be brought to abut against this bar.

Transversal bar $8_a$ of the protuberance and a small portion of each lateral bar located close thereto thus form in this case precise positioning means for the portion $3_b$ of the buckle. The remainder of the lateral bars $8_b$ and $8_c$ serve to guide the portion $3_b$ towards these positioning means when it is brought into contact with the bottom 4 and caused to slide along the latter.

Naturally, the best manner of actuating the contacts 6 and 7 is the same as with the watch of FIG. 1 but, when one must act several times on the same contact, one may also employ more easily the solution which consists of separating the transversal portion of the buckle from this contact while maintaining one of its ends supported against the bottom.

It is to be noted that this form of the invention may inspire another in which the protuberance in the form of an H would be replaced by a protuberance in the form of an X and in which the contacts, no longer actionable by the transversal portion $3_b$ of the buckle, but by the tongue $3_a$, would be placed in proximity to the crossing point of the bars of the X. One could thus provide up to four contacts which instead of being flush with the surface of the bottom, would be depressed relative thereto and thus better protected. One could even replace these contacts by push-buttons which wold eliminate the necessity of having a metallic bottom cover.

The watch of FIG. 3 includes only a single contact located at the center of the back cover and identical with contacts 6 and 7 of the watches of FIGS. 1 and 2. On the other hand, back cover 4 no longer provides only a single protuberance, designated here by reference 10, but also a groove 11, both being approximately rectilinear and perpendicular to the longitudinal direction of the bracelet, and being situated on either side of contact 9 substantially at equal distance therefrom. The groove 11 which is located on the side of strand $2_b$ of the bracelet which bears buckle 3 has a length slightly greater than that of the transversal portion $3_b$ of this latter and preferably a form which is semi-cylindrical or approximately so in order that this transversal portion may be engaged therein and removed therefrom easily when it is caused to slide on the back cover. The protuberance 10 has a form and dimensions which permit it to respond to the same criteria and to play the same role, in particular in respect of the buckle as that of the watch of FIG. 1.

Thus, after having applied portion $3_b$ of the buckle to the back cover close to the place where the strand $2_b$ of the bracelet is fastened, it is moved in the direction of the other stand $2_a$, whence there is first of all encountered the groove 11 which enables placing such portion $3_b$ at the center of the bottom and approximately parallel to that of the protuberance 10 if it was not already so and which consequently assures the ultimate actuation of the contact. The groove 11 thus serves as pre-positioning means for the buckle. Furthermore, when one imparts to such buckle a back and forth movement along the back cover, the groove is associated with the protuberance 10 to limit the amplitude of this movement and to maintain the portion $3_b$ more or less in the direction which was given to it at the beginning.

The watch of FIG. 4 comprises a case 12 for example of rectangular form to which is fastened in any desired manner a metallic bracelet 13 provided with a folding clasp 14 formed with three articulated platelets $14_a$, $14_b$ and $14_c$.

The manner in which case 12 is made is of still less importance than that in the case of the preceding watches for it is not even necessary that the back cover 15 be metallic.

The back cover 15 exhibits two grooves 16 and 17 essentially parallel to one another and which extend in the sense of the width of the case and from the bottom of each of which emerge two fixed electrical contacts 18, 19, respectively 20, 21 which in order to be actuated must be connected to one another by a metallic object. Naturally, if the back cover of the case is itself metallic, the contacts must be insulated from one another.

As far as grooves 16 and 17 are concerned, it should be stated that their length and width are chosen in a manner such that one may easily engage therein the portions of the clasp in which are found hinges $14_d$ and $14_e$ which connect the center platelet 14b to the other two $14_a$ and $14_c$ respectively, it is of interest that these be sufficiently separated from one another but not too close to the edges of the case. A good compromise consists in having the length of the case divided approximately into three equal parts.

Taking into account what has just been said the manner of actuating one or the other of these pairs of contacts by means of the clasp 14 is evident. It is sufficient to bring hinge $14_d$ or $14_e$ into the correct groove as is shown on the figure. Should one wish to actuate the same pair of contacts several times, it is possible to remove each time the hinge from the groove and to return it thereafter, or to maintain such hinge bearing on one of the contacts and to separate it uniquely from the other. The first solution is perhaps easier from the point of view of manipulation, but if utilized there is a risk of requiring longer to actuate the contacts the same number of times than if one employed the second method.

The watch of FIG. 4 shows certain advantages relative to those of FIGS. 1 to 3. The contacts are better protected against involuntary actuation thereof, and contrary to what may occur using protuberances, slots 16 and 17 do not run any risk of ruining the appearance of the watch and there are no precautions to take in order that the wearer is not bothered by their presence. On the other hand, although it is still easy to actuate the contacts, it is a little less so than in the case of the preceding watches.

Figure 4A:
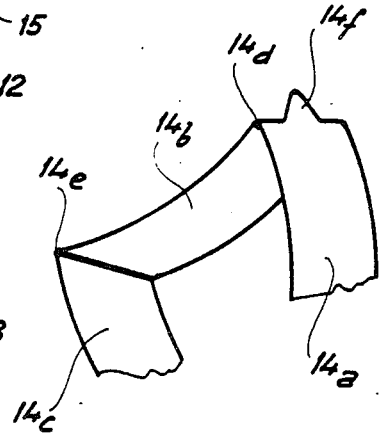
FIG. 4*a* shows partially a variant of the bracelet clasp of the watch of FIG. 4.

A variant of the watch of FIG. 4 may be obtained by replacing grooves 16 and 17 by two cylindrical holes or preferably conical holes located on the longitudinal median line of the back cover, the opening of which would be sufficiently large that one might easily find them and at the bottom of each of which would be placed a push button or a contact which could be actuated by connecting it to the bottom 15 which in this case would be necessarily metallic. In order to be able to continue to employ the clasp of the bracelet as a means of actuation, it would be sufficient that one of the platelets $\mathbf{14}_a$, $\mathbf{14}_b$ or $\mathbf{14}_c$ be prolonged beyond the coupling hinge by a point adapted to the form and to the dimensions of the holes, as may be seen on FIG. 4*a* and which is designated by reference $\mathbf{14}_f$. As may be well understood, this point could be moreover conformed and placed in a manner so as neither to be in the way of nor to risk injuring the wearer.

The watch of FIG. 5 has the same case 12, the same bracelet 13 and the same pairs of contacts 18, 19 and 20, 21 as that of FIG. 4. The sole difference is that the grooves 16 and 17 are replaced by two cavities 22 and 23 of more complex form. Each cavity exhibits proximate the center of the back cover 15 an abruptly plunging longitudinal side $\mathbf{22}_a$, respectively $\mathbf{23}_a$ at the bottom of which is found the pair of contacts, another longitudinal side $\mathbf{22}_b$, respectively $\mathbf{23}_b$, slightly inclined facing the former and two lateral flanks which on either side of the bottom where the contact pairs are located, are parallel between themselves and which thereafter diverge from one another when they bound the inclined longitudinal side.

It is to be noted that there will be no particular difficulty if the abruptly plunging sides are both oriented from the same side and the inclined planes from the other.

There will be immediately seen the similarity between the transformation of the watch of FIG. 4 to that of FIG. 5 and that of FIG. 1 to that of FIG. 3. Thus the watch of FIG. 4 includes only positioning means for clasp 14 constituted by grooves 16 and 17 while that of FIG. 5 has at the same time positioning means formed by the abruptly plunging sides $\mathbf{22}_a$, $\mathbf{23}_a$ and the portions of the lateral flanks $\mathbf{22}_c$, $\mathbf{22}_d$, $\mathbf{23}_c$, $\mathbf{23}_d$ which are parallel to one another and guide means formed by the inclined planes $\mathbf{22}_b$, $\mathbf{23}_b$ and the remainder of the lateral flanks.

On the other hand, it is easy to imagine a variant of the watch of FIG. 5 which would correspond to that envisaged for the watch of FIG. 4. This would be that in which each cavity would no longer have other than an inclined plane and two sides forming a V at the bottom of which would be placed a push-button or a contact actuable by a point as shown on the clasp.

Figure 6:
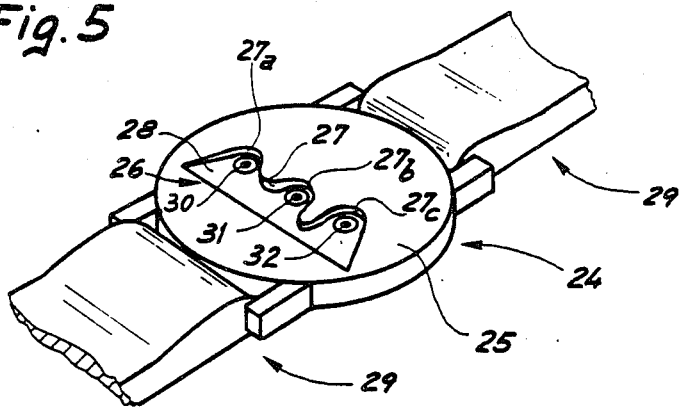

In the last embodiment in accordance with the invention to be described and which is shown on FIG. 6, the back cover 25 of the case 24 exhibits a single cavity 26 with an abruptly plunging side 27 somewhat in the form of a sine curve, the general direction of which is substantially perpendicular to the longitudinal direction of the bracelet 29, and a plane 26 inclined toward this side.

In the three depressions $\mathbf{27}_a$, $\mathbf{27}_b$ and $\mathbf{27}_c$ shown by the side 27 are to be found three push buttons 30, 31, 32 or, eventually, three fixed electrical contact if the bottom of the case is metallic and which, for a simple watch, the first 30 may correct the hours indication, the second 31 the minutes indication and the third 32 may reset the seconds to zero.

To act on one of these control mechanisms, it is sufficient to provide oneself with a pointed object which could be the tongue of the buckle if the bracelet has one, to bring such into contact with the back cover of the case approximately facing the corresponding depression and to slide it approximately perpendicular to the general direction of the cavity until it is brought to abut against side 27. If one is fortunate to land immediately on the mechanism, there is nothing more than to actuate this as desired. If this should not be the case, one has only to be guided by the side 27 in order to reach it. Side 27 may equally serve to pass from one mechanism to another.

On FIG. 6 the projection separating the depression $\mathbf{27}_b$ from the depression $\mathbf{27}_a$ is much less pronounced than that which separates it from depression $\mathbf{27}_c$. This indicates that it is not particularly troublesome should one mistakenly actuate one of the mechanisms 30 and 31 when one had wanted to act on the other, but the matter must be regarded differently as far as the mechanisms 31 and 32 are concerned. This signifies the desirability of eliminating the risk that mechanism 32 be involuntarily actuated when one had sought to pass rapidly from mechanism 30 to mechanism 31. It is clear in effect that the less the projections extend, the greater the chances of error, but it happens quite often with classical mechanisms that one does not bring the stem of the time setting mechanism immediately into the proper axial position to obtain the desired correction or that one commences by turning it in one sense when it should have been turned in the other.

Finally, to terminate, it is necessary to specify that if in the six embodiments which have just been described and in the possible variants indicated, the positioning and guiding means are always formed by profiles or by cavities, it is because this is the simplest and most economic manner to practise the invention. Effectively, for a metallic case or at least a metallic bottom cover, it will be possible in most situations to form such profiles or cavities by stamping and as this technique is already greatly used for the manufacture of back covers or cases in a single piece, this will often necessitate no additional operation. If this is excluded or if it is not advantageous to employ this method, one may revert to another, for instance that of milling or grinding. For a case of plastic material it is sufficient to provide the correct form by a mould.

On the other hand, taking into account that the number of different types of control mechanisms are numerous, as has been seen, that the number of these mechanisms may vary from one to four and even more if necessary in similar watch designs, that the mechanisms of bracelet closure which actually exist are extremely varied, that one may no doubt find others, that one may very well foresee positioning means adapted not to these mechanisms, but to other possibilities, for example to the form of a finger and finally that the invention is not limited to wristwatches, it is easily imaginable that with nothing other than the solution of the cavities, the protuberances and their combination, the possibilities of realizing a watch in conformity with the invention are unlimited, above all when one considers such cavities and protuberances not only from the practical aspect, but as well from the decorative aspect.

Nevertheless, the invention is not limited to this type of positioning and guiding means and, to show that it is possible to remain in the framework of the latter even in going far from the forms of execution which have been described, one may cite the example of a watch in the back cover of which would be incorporated at least one tablet of magnetic material having just behind it an electromagnetic relay and wherein the closing organ of the bracelet would be provided with a small permanent magnet enabling the actuation of the relay. One could even further provide as guiding means in the back cover one or several tracks of magnetic material which would end up at the tablet.

What I claim is:

1. An electronic watch including a case having a back cover and at least one control mechanism fixed to said back cover, said back cover having positioning means which determine at least approximately the location at which means external to the case must be placed in order to actuate said control mechanism, and a bracelet having a fastening element, said control mechanism being selected and placed in the back cover in a manner such that at least a portion of said fastening element may be employed as external actuating means therefor and said positioning means being adapted to accommodate the form and dimensions of said portion of said fastening element.

2. An electronic watch as set forth in claim 1, said back cover being further provided with means to guide said external means toward said positioning means.

3. An electronic watch as set forth in claim 1 wherein the back cover exhibits proximate its center an elongated protuberance to serve as positioning means for the actuation of two control mechanisms located on either side thereof substantially along the median line of said back cover perpendicular to the direction in which the protuberance extends.

4. An electronic watch as set forth in claim 3 wherein the protuberance extends in the direction of the bracelet width.

5. An electronic watch as set forth in claim 4, said control mechanisms being located in the immediate vicinity of said protuberance so as to be adapted to be actuated by said portion of the fastening element when the latter is similtaneously urged against the back cover and said protuberance.

6. An electronic watch as set forth in claim 1 wherein the control mechanism is located proximate the center of the back cover and said positioning means comprise an elongated protuberance and a groove substantially rectangular and parallel to one another extending in the direction of the bracelet width and located on either side of the control mechanism said groove being so dimensioned that said portion of the fastening element may be accommodated therein.

7. An electronic watch as set forth in claim 1, the back cover exhibiting a protuberance substantially in H form having a transversal bar extending in the direction of the bracelet width, of a length at least equal to the dimension in the same direction of said portion of the fastening element and two lateral bars the facing sides of which diverge from one another as their distance from the transversal bar increases, there being two control mechanisms placed on either side of and in the immediate vicinity of said transversal bar, said transversal bar being thus adapted to serve in cooperation with a portion of each lateral bar proximate thereto as positioning means for the actuation of each of said control mechanisms, the remaining part of said lateral bars serving to guide said portion of the fastening element toward such positioning means.

8. An electronic watch as set forth in claim 1, the back cover exhibiting a groove extending substantially in the direction of the bracelet width, at the bottom of of which is placed said control mechanism, said groove being dimensioned to accommodate said portion of the fastening element.

9. An electronic watch as set forth in claim 8 wherein the back cover exhibits a further groove having substantially the same orientation and dimensions as the first mentioned groove and at the bottom of which is placed a further control mechanism.

10. An electronic watch as set forth in claim 1 in which the back cover exhibits a cavity with a first longitudinal side plunging abruptly and being substantially straight, oriented in the direction of the bracelet width and of a length at least equal to said portion of the fastening element in the same direction, a bottom in which is palced the control mechanism, a second longitudinal side slightly angled facing said first side and two abruptly plunging lateral sides which diverge from one another as their distance increases from the bottom of said cavity, said first longitudinal side and the portions of said lateral sides which bound said bottom thus being adapted to act as positioning means for the actuation of said control mechanism and the second longitudinal side together with the portions of the lateral sides which bound it serving to guide said portion of the fastening element towards such positioning means.

11. An electronic watch as set forth in claim 10 in which the back cover exhibits a further cavity substantially identical to the first-named cavity at the bottom of which is placed a further control mechanism.

12. An electronic watch as set forth in claim 1 the bracelet of which comprises two strands and a buckle with a transversal portion upon which the free end of a tongue may be supported, said portion of the fastening element being said transversal portion of the buckle.

13. An electronic watch as set forth in claim 1 the bracelet of which comprises two portions connected to one another by a folding clasp which includes at least two platelets pivoted to one another by a hinge, said portion of the fastening element being the portion of the clasp in which said hinge is located.

14. An electronic watch as set forth in claim 1 in which said positioning means comprises a protuberance on the exterior of the back cover and which bounds a zone in which the control mechanism is situated.

15. An electronic watch as set forth in claim 1 in which said positioning means comprise a cavity in the back cover at the bottom of which the control mechanism is situated.

16. An electronic watch as set forth in claim 2 in which said positioning and guiding means are formed by a raised portion on the exterior of the back cover.

17. An electronic watch as set forth in claim 2 in which said positioning and guiding means are formed by at least one cavity in the outer part of the back cover at the bottom of which the control mechanism is situated.

* * * * *